US006539721B2

(12) United States Patent
Oikawa et al.

(10) Patent No.: US 6,539,721 B2
(45) Date of Patent: Apr. 1, 2003

(54) GAS-LIQUID PREMIXER

(75) Inventors: Stephen Oliver Oikawa, Toronto (CA); Wei Tang, Brampton (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/901,068

(22) Filed: Jul. 10, 2001

(65) Prior Publication Data

US 2003/0010030 A1 Jan. 16, 2003

(51) Int. Cl.[7] ..... F02C 3/00; F02C 9/40

(52) U.S. Cl. ..... 60/737; 60/39.463; 60/748; 60/742

(58) Field of Search ..... 60/737, 742, 748, 60/740, 39.463; 239/400, 402, 403, 419, 419.3

(56) References Cited

U.S. PATENT DOCUMENTS

| | | | | | |
|---|---|---|---|---|---|
| 3,808,803 | A | * | 5/1974 | Salvi | 60/737 |
| 3,859,787 | A | * | 1/1975 | Anderson et al. | 60/748 |
| 3,927,958 | A | * | 12/1975 | Quinn | 60/39.52 |
| 3,958,416 | A | | 5/1976 | Hammond, Jr. et al. | |
| 4,162,611 | A | * | 7/1979 | Caruel et al. | 60/748 |
| 4,701,124 | A | * | 10/1987 | Maghon et al. | 60/748 |
| 5,062,792 | A | * | 11/1991 | Maghon | 60/748 |
| 5,145,361 | A | | 9/1992 | Kurzinski | 432/19 |
| 5,359,847 | A | | 11/1994 | Pillsbury et al. | |
| 5,402,633 | A | | 4/1995 | Hu | |
| 5,450,725 | A | | 9/1995 | Takahara et al. | |
| 5,452,574 | A | * | 9/1995 | Cowell et al. | 60/746 |
| 5,511,375 | A | | 4/1996 | Joshi et al. | |
| 5,592,819 | A | | 1/1997 | Ansart et al. | 60/737 |
| 5,647,538 | A | * | 7/1997 | Richardson | 239/405 |
| 5,675,971 | A | | 10/1997 | Angel et al. | |
| 5,899,074 | A | | 5/1999 | Komatsu et al. | |
| 6,035,645 | A | * | 3/2000 | Bensaadi et al. | 60/748 |
| 6,038,864 | A | | 3/2000 | Prade et al. | |
| 6,085,111 | A | | 7/2000 | André | |

(List continued on next page.)

FOREIGN PATENT DOCUMENTS

| | | |
|---|---|---|
| DE | 675 878 C | 5/1939 |
| EP | 0 269 824 A | 6/1988 |
| EP | 0 845 634 A | 6/1988 |
| FR | 935 322 A | 6/1948 |

*Primary Examiner*—Ted Kim
(74) *Attorney, Agent, or Firm*—Ogilvy Renault

(57) ABSTRACT

A fuel and gas mixer for a gas turbine combustor includes a body member. The body member has a truncated conical annulus, with its smaller end which communicates with a smaller end of a downstream truncated conical chamber. Gaseous fuel is injected into the annulus through hollow spokes arranged radially in the annulus and mixes with air flow introduced from air upstream passages. The velocity of the primary mixture of the fuel and air in the annulus increases when the flow is directed towards the downstream chamber because the truncated conical shape of the annulus reduces the cross-section of the flow passageway downstream-wise. With increased velocity, the primary mixture is diffused when entering the truncated conical chamber and is further mixed with air introduced from downstream air passages. The body member of the mixer further includes a central air passage with liquid fuel injection holes which are connected to a liquid fuel source such that the air flow entering the central passage delivers the liquid fuel into the chamber and the liquid fuel is mixed with air. The independent liquid fuel injection provides an option for the mixer of the gas turbine combustor when the liquid injection is required as, for example, in a back-up situation. The mixer according to the present invention provides an apparatus to improve a combustion process, especially under a very lean condition.

15 Claims, 2 Drawing Sheets

U.S. PATENT DOCUMENTS 6,174,160 B1 * 1/2001 Lee et al. ..... 60/737
6,189,314 B1 2/2001 Yamamoto et al.
6,189,320 B1 2/2001 Poeschl et al.
6,311,473 B1 * 11/2001 Benjamin et al. ..... 60/737
6,332,313 B1 * 12/2001 Willis et al. ..... 60/737
6,374,593 B1 * 4/2002 Ziegner ..... 60/737

* cited by examiner

GAS-LIQUID PREMIXER

FIELD OF THE INVENTION

The present invention relates to gas turbine engines, especially to a fuel and air mixer for a gas turbine combustor, and more particularly to a gas-liquid mixer which may be used as a mixer of a combustor for the type of gas turbine engine which may be used in power plant applications.

BACKGROUND OF THE INVENTION

Low $NO_x$ emission levels from a turbine engine, of below 10 volume parts per million (ppmv), are becoming important criteria in the selection of turbine engines for power plant applications. The current technology for achieving low $NO_x$ emissions may require a fuel/air premixer. Combustors that achieve low $NO_x$ emissions without water injection are known as dry-low-emissions (DLE) and offer the prospect of clean emissions combined with high engine efficiency. The technology relies on a high air content in the fuel/air mixture.

In a DLE system, fuel and air are lean-premixed prior to injection into the combustor. No diluent additions, such as water injection are needed for significantly lower combustion temperatures, which minimizes the amount of nitrogen oxide formation. However, two problems have been observed. The first is combustion instability or unstable engine operability which results in decreasing combustion efficiency. The stability of the combustion process rapidly decreases at lean conditions and the combustor may be operating close to its blow-out limit because of the exponential temperature dependence of chemical reactions. This also can lead to local combustion instabilities which change the dynamic behavior of the combustion process, and endangers the mechanical integrity of the entire gas turbine engine. This is because several constraints are imposed on the homogeneity of the fuel/air mixture since leaner than average pockets of mixture may lead to stability problems, and richer than average pockets will lead to unacceptably high $NO_x$ emissions. At the same time, a substantial increase in carbon monoxide and unburned hydrocarbon (UHC) emissions as a tracer for combustion efficiency is observed, which is due to the exponential decrease in chemical reaction kinetics at leaner mixtures for a given combustor.

It has been found that a key requirement of a successful DLE catalytic combustion system is the reaction of a perfectly mixed gaseous fuel and air mixture that has less than a 5% variation in fuel/air ratio.

It is also desirable that gaseous and liquid fuels be selectively used for the combustion process under different conditions during engine operation. For example, liquid fuel may be used in a backup system for emergencies while gaseous fuel is used for normal operation.

SUMMARY OF THE INVENTION

It is an object of the present invention to provide a fuel and air mixer which is capable of providing a better fuel/air mixture.

It is another object of the present invention to provide a gas and liquid mixer which is capable of providing a fuel/air mixture using both gaseous fuel and liquid fuel.

It is a further object of the present invention to provide a fuel and air mixer which is relatively convenient to manufacture.

In accordance with one aspect of the present invention, a mixer for a gas turbine combustor is provided. The mixer comprises a chamber having a substantially truncated conical shape with an upstream end having a diameter smaller than a diameter of an open downstream end of the chamber. A truncated conical annulus at the downstream end thereof communicates with the chamber at the upstream end thereof. The truncated conical annulus thus has a diameter at the downstream end thereof smaller than a diameter of an upstream thereof. The mixer includes a first fuel injection means disposed in the annulus for injecting fuel into the annulus, and a plurality of upstream air passages communicating with the annulus. The upstream air passages are located upstream of the first fuel injection means for supplying air flow into the annulus to mix with the fuel injected into the annulus, thereby forming a fuel and air mixture. The mixer further includes a plurality of downstream air passages communicating with the chamber. The downstream air passages are located adjacent to the upstream end of the chamber for introducing air flow to further mix in the chamber with the fuel and air mixture.

The fuel injected from the first fuel injection means is mixed with air in the annulus, and the fuel and air mixture flows downstream into the chamber and is further mixed with the air introduced from the downstream air passages. When the air flow from the upstream air passages and the mixture formed in the annulus travel downstream through the annulus, the velocity of fluid flow increases since the cross-sectional area of the annulus decreases from the upstream end to the downstream end. The increased velocity of fluid flow improves the mixing of fuel and air.

It is preferable to provide a central passage communicating with the chamber at a center of the upstream end thereof for supplying air flow into the chamber. The central passage preferably comprises a second fuel injection means adjacent to the bottom of the chamber for injecting fuel therein to mix with air. The second fuel injection means is adapted to operate independently from the first fuel injection means in the annulus so that the second fuel injection means may be used for optional liquid fuel injection while the first fuel injection means is used for gaseous fuel injection.

More specifically, a mixer for a gas turbine combustor according to an embodiment of the present invention, is formed with a body member having a central axis extending between opposed upstream and downstream ends. A central chamber is formed in the body member, including a truncated conical section. The chamber extends inwardly from the downstream end of the body forming an open end thereof, and terminates inside the body member forming a bottom thereof. The bottom has a diameter smaller than a diameter of the open end. A truncated conical annulus is formed in the body member upstream of the chamber. The annulus includes a small end and a large end. The annulus communicates at the small end thereof with the bottom of the chamber. A plurality of upstream air holes extend inwardly from the upstream end of the body member in fluid communication with the annulus and the exterior of the body member, for introducing air flow into the annulus. A plurality of hollow spokes extend radially in the annulus and are disposed in a circumferentially spaced apart relationship. Each of the hollow spokes includes a plurality of first fuel holes for injecting fuel into the annulus to mix with air, thereby forming a fuel and air mixture. A plurality of downstream air holes extend through the body member in fluid communication with the truncated conical section and the outside of the body member for introducing air flow into the chamber to further mix with the fuel and air mixture.

The body member preferably comprises a central passage extending axially from the upstream end thereof to the bottom end of the chamber for supplying air flow into the chamber. The central passage preferably comprises a plurality of second fuel injection holes adjacent to the bottom of the chamber for selectively injecting fuel to mix with air. The upstream and downstream air holes are preferably in angled orientation to create air swirl which further improves the mixing of fuel with air.

For convenience of manufacturing, the body member preferably comprises a base body including the chamber and a truncated conical cavity forming an outer wall of the annulus, and an end body including a plate and a truncated conical central member extending from the plate and oriented perpendicular thereto. The plate forms the upstream end of the body member and the central member forms an inner wall of the annulus when the end body is assembled together with the base body.

The mixer, according to the present invention, improves the mixing of fuel with air to increase the flame stability, especially under lean conditions, and is convenient to manufacture.

Other advantages and features of the present invention will be better understood with reference to a preferred embodiment of the invention described hereinafter.

BRIEF DESCRIPTION OF THE DRAWINGS

Having thus generally described the nature of the invention, reference will now be made to the drawings, by way of example, showing a preferred embodiment, in which.

DETAILED DESCRIPTION OF THE PREFERRED EMBODIMENT

The fuel and air mixers of the present invention can be used as both stage one mixers and stage two mixers with gas engine combustors. The following embodiment having the mixers of the present invention used as stage two mixers illustrates one example of the application of the present invention, and does not exclude other applications of the present invention, such as using the mixers of the present invention as stage one mixers.

Figure 1:
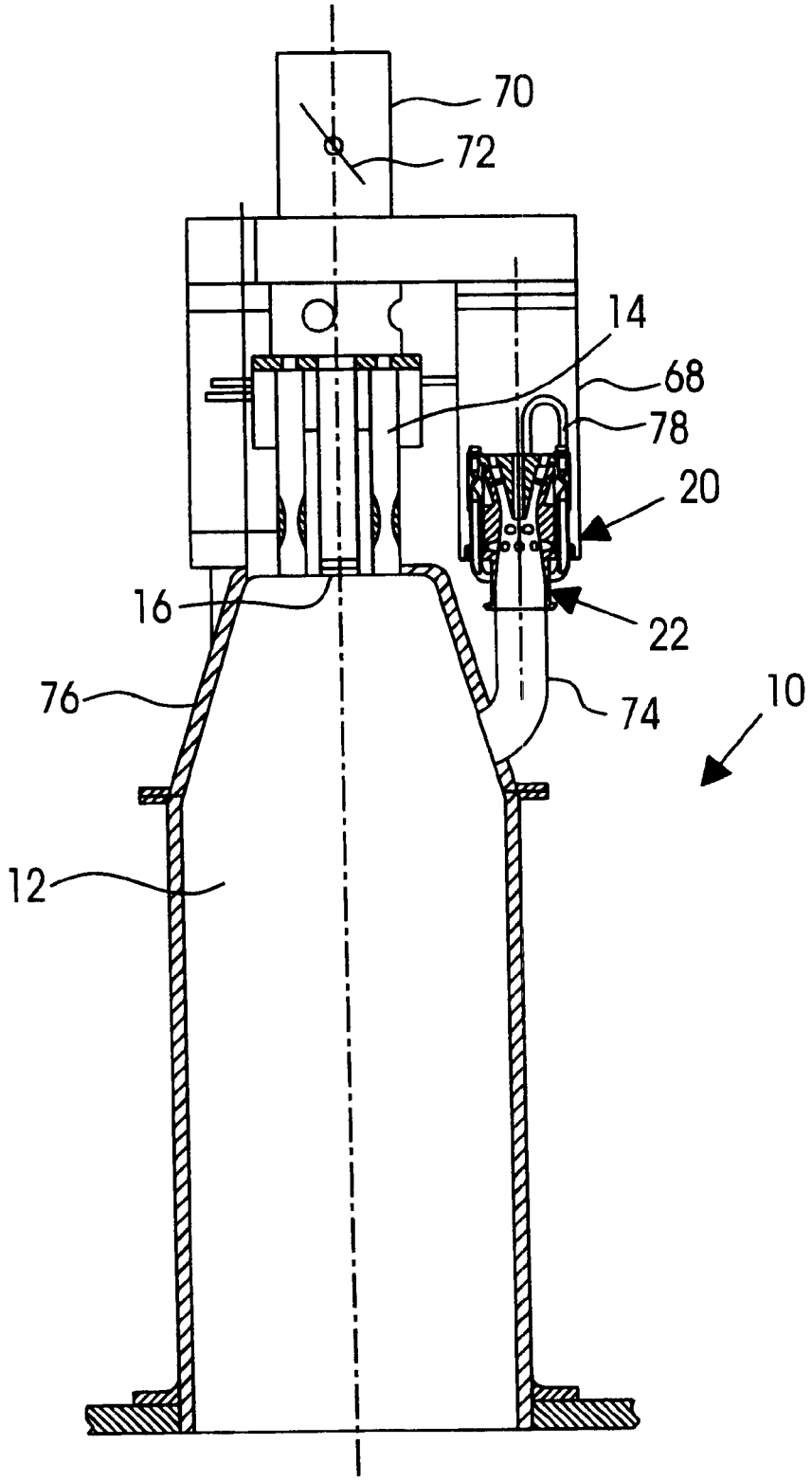
FIG. 1 is a cross-sectional view of a gas turbine combustor incorporated with a preferred embodiment of the invention.

Referring to the drawings, particularly to FIG. 1, a gas turbine combustor assembly, generally indicated at numeral 10 includes a combustor chamber 12. A stage one mixer 14 is affixed at a central inlet at the end of the combustion chamber 12 for mixing fuel with air to form a fuel and air-mixture in the combustor chamber 12. Three stage two mixers 20 are connected to the combustion chamber 12 respectively, and are disposed downstream of the stage one mixer 14, in a circumferentially spaced apart relationship around the combustion chamber 12. Only one stage two mixer 20 is shown.

The combustion chamber 12 is not part of the invention. The stage one mixer 14 could have similar structures as the stage two mixer 20 which will be described in details with reference to FIG. 2. Nevertheless, the stage one mixer 14 shown in FIG. 1, is a type of diffusion mixer an example of which is described in U.S. patent application Ser. No. 09/742,009, entitled DIFFUSION MIXER filed on Dec. 22, 2000, which is assigned to the Assignee of this patent application, and which is incorporated herein by reference.

The three stage two mixers 20 are located downstream of the stage one mixer 14. Each stage two mixer 20 includes a body member 22, which is more clearly shown in FIG. 2. The body member 22 is generally cylindrical and has a central axis 24 extending between the opposed upstream end 26 and the downstream end 28. The body member 22 includes a base body 30 and an end body 32.

Figure 2:
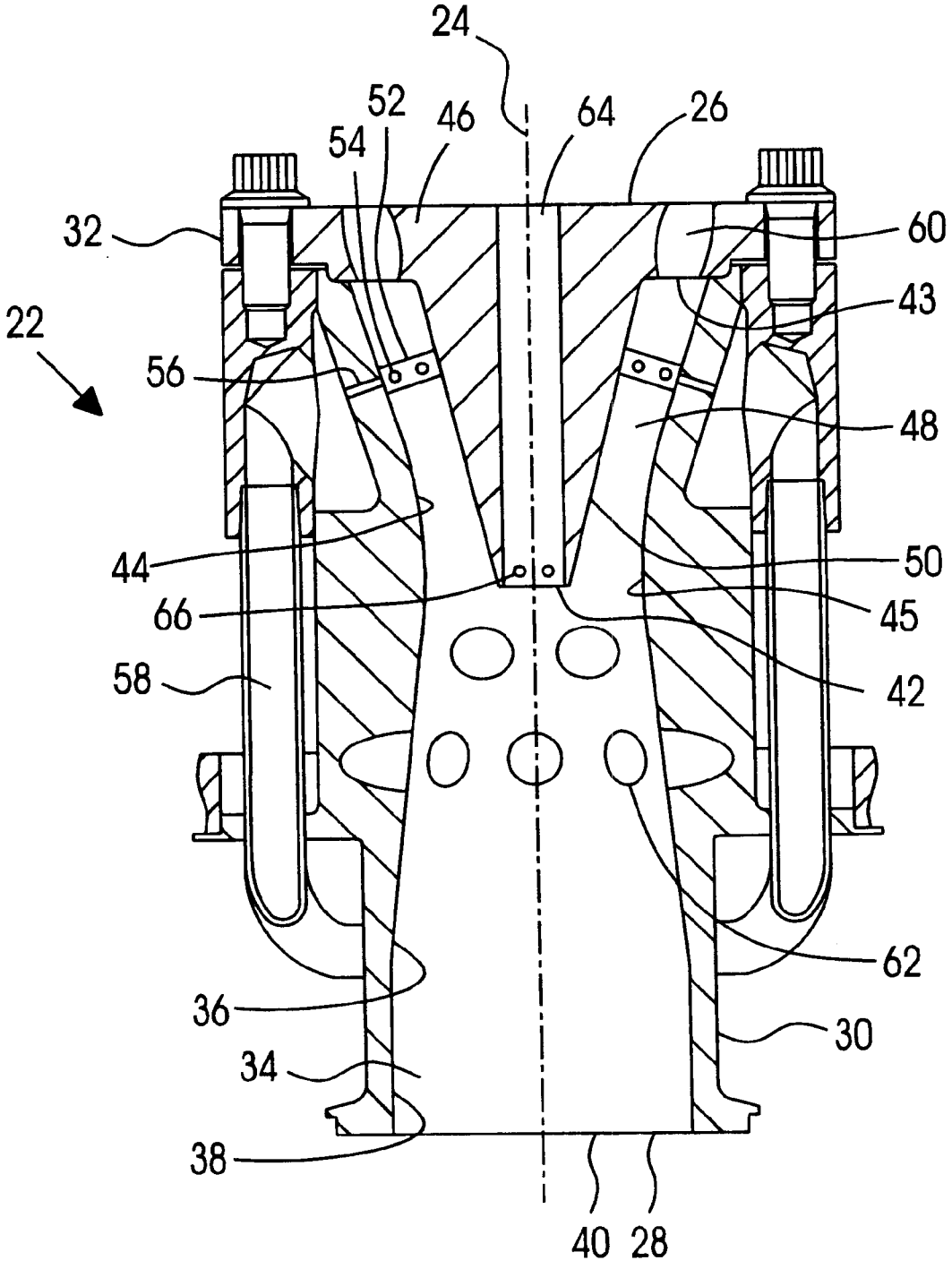
FIG. 2 is an enlarged cross-sectional view of a body member of a mixer according to the embodiment illustrated in FIG. 1, showing the structural details thereof.

As shown in FIG. 2, a central chamber 34 is formed in the base body 30 and includes a truncated conical section 36 and a cylindrical section 38. The central chamber 34 extends from the downstream end 28, forming an open end 40 thereof, and terminates inside of the base body 30, forming a bottom 42 thereof. The bottom 42 of the chamber 34 has a diameter smaller than the diameter of the open end 40 of the chamber 34.

A truncated conical cavity 44 is formed in the base body 30 upstream of the central chamber 34. The truncated conical cavity 44 has an upstream end 43 of a large diameter and a downstream end 45 of a small diameter which is equal to the diameter of the bottom 42 of the chamber 34 such that the downstream end 45 of the cavity 44 and the bottom 42 of the chamber 34 are smoothly integrated to form a throat configuration within the base body 30.

The end body 32 includes a plate 46 and a truncated conical central member 50 extending perpendicularly relative to and integrally projecting from the plate 46. Thus, when the end body 32 is assembled together with the base body 30, as shown in FIG. 2, a truncated conical annulus 48 is formed between the base body 30 and the end body 32, the cavity 44 forming an outer wall of the annulus 48 and the central member 50 forming an inner wall of the annulus 48 and a central part of the bottom 42 of the chamber 34. The plate 46 of the end body 32 forms the upstream end 26 of the body member 22.

A plurality of hollow spokes 52 are disposed radially in the annulus 48, circumferentially spaced apart from one another. Each spoke 52 includes a plurality of fuel injection holes 54 and communicates with a fuel passage 56 which extends through the base body 30 in fluid communication with gaseous fuel supply pipes 58 so that gaseous fuel supplied to the mixer is injected through the hollow spokes 52 into the annulus 48.

A plurality of upstream air holes 60 extend from the upstream end 26 axially through the plate 32, communicating with the annulus 48 for supplying pressurized air into the annulus 48 to mix with the gaseous fuel injected into the annulus 48, to form a fuel and air mixture. The upstream air holes 60 are also oriented in a circumferential direction with respect to the annulus 48 to create an air swirl in the annulus 48, which promotes the even mixing of the fuel and air. A plurality of downstream air holes 62 are provided in the truncated conical section 36 of the chamber 34 adjacent to the bottom 42 thereof. The downstream air holes 62 are disposed in two rows, circumferentially spaced apart from one another in each row. The downstream air holes 62 extend radially and circumferentially through the base body 30 to establish a fluid communication between the chamber 34 and the exterior of the base member 22 for introducing additional air flow and creating an air swirl in the chamber 34 to mix with the fuel and air mixture which is formed in the annulus 48 and flows downstream-wise into the chamber 34. Because of the truncated conical shape of the annulus 48, the cross-section of the passageway for the fuel and air mixtures formed in the annulus 48 is gradually reduced downstream-wise, thereby the velocity of the mixture flow increases. The increased velocity of the mixture improves the further mixing process with the additional air flow from the downstream air holes 62 to achieve a better mixing result.

The end body 32 further includes a central passage 64 extending axially from the upstream end 26 to the bottom 42 of the chamber 34, communicating with the chamber 34 for supplying air flow into the chamber 34. The central passage 64 includes a plurality of fuel injection holes 66 which are adjacent to the bottom 42 of the chamber 34 and extend through the end body 32 in fluid communication with a liquid fuel source (not shown) for optionally injecting liquid fuel into the central passage 64. The liquid fuel injected into the central passage is mixed with and carried by the air flow through the central passage 64 into the chamber 34 in which the liquid fuel is further mixed with air. In such an arrangement, the stage two mixers 20 as shown in FIG. 1 are adapted to provide liquid gas and air mixture to the combustor chamber 12 if it is requested. The liquid fuel is delivered to the mixer 20 through a liquid fuel pipe 78 as shown in FIG. 1, which is connected to the end base 32 and communicates with liquid fuel injection holes 66 thereof (FIG. 2).

The base body 30 is brazed and machined. The machined base body 30 is assembled with the hollow spokes 52 and the gaseous fuel pipe 58. The end body 32 is machined and then bolted to the base body assembly. Nevertheless, both the end body 32 and the base body 30 could be cast.

As shown in FIG. 1, each of the stage two mixers 20 includes a can chamber 68 communicating with a pressurized air source through an air pipe 70 in which a butterfly valve 72 is provided for controlling the air flow to the three stage two mixers 20. Alternatively, the butterfly valve 72 could be replaced by other types of flow control valves and three valves might also be provided, each controlling the air supply to one of the stage two mixers 20. The can chamber 68 sealingly houses a major section of the body member 22 of the stage two mixer 20 so that the air under pressure in the can chamber 68 enters the upstream and downstream air holes 60 and 62, respectively, as well as the central passage 64.

Each of the stage two mixers 20 is in fluid communication with the combustion chamber 12 through a tube 74. The tube 74 at its one end is assembled with the downstream end of the body member 30, and at the other end is bent to a proper angle and connected to the truncated conical end section 76 of the combustion chamber 12, preferably at a 30° angle with respect to the combustion chamber 12 to create a fluid swirl when the fuel and air mixture is delivered through the tube 74 into the combustion chamber 12, thereby, improving the combustion reaction in the combustion chamber.

Modifications and improvements to the above described embodiment of the invention may become apparent to those skilled in the art. The forgoing description is intended to be exemplary rather than limiting. The scope of the invention is therefore intended to be limited solely by the scope of the appended claims.

We claim:

1. A mixer for a gas turbine combustor comprising:

a chamber having a substantially truncated conical shape with an upstream end having a diameter smaller than a diameter of an open downstream end of the chamber;

a truncated conical annulus having a diameter at a downstream end thereof, smaller than a diameter of an upstream end thereof, the annulus at the downstream end thereof communicating with the chamber at the upstream end thereof;

a first fuel injection means disposed in the annulus for injecting gaseous fuel into the annulus;

a plurality of upstream air passages communicating with the annulus, located upstream of the first fuel injection means for supplying air flow into the annulus to mix with the gaseous fuel injected into the annulus, thereby forming a fuel and air mixture;

a plurality of downstream air passages communicating with the chamber, located adjacent to the upstream end of the chamber for introducing air flow, to further mix in the chamber with the fuel and air mixture;

a central passage directly communicating with the chamber at a center of the upstream end thereof for supplying air flow into the chamber; and a second fuel injection means disposed adjacent to the upstream end of the chamber for injecting liquid fuel into the central passage to mix with air therein.

2. A mixer as claimed in claim 1 wherein the first fuel injection means comprises a plurality of hollow spokes extending radially in the annulus and disposed in a circumferentially spaced apart relationship, each spoke having a plurality of passages for injecting gaseous fuel into the truncated conical annulus.

3. A mixer as claimed in claim 1 wherein the second fuel injection means comprises a plurality of liquid fuel passages in communication wit the central passage for injecting liquid fuel into the central passage.

4. A mixer for a gas turbine combustor comprising:

a base body having a central axis extending between opposed upstream and downstream ends, the base body including:

a central chamber formed in the base body including a truncated conical shaped section, the chamber extending inwardly from the downstream end of the base body forming an open end thereof, and terminating inside the base body;

a truncated conical cavity formed in the base body upstream of the chamber, and communicating and being smoothly integrated with the chamber to form a throat therebetween;

an integral end body including a plate and a truncated conical central member integrally and perpendicularly projecting from the plate into the truncated conical cavity of the base body, the plate member forming an upstream end of the base body, an end of the central member forming a central part of a bottom of the chamber, and a truncated conical annulus being formed between the central member and the cavity;

a plurality of upstream air passages extending inwardly from the upstream end of the body member in fluid communication with the annulus and the exterior of the base body for introducing air flow into the annulus;

a plurality of hollow spokes extending radially in the annulus and disposed in a circumferentially spaced apart relationship, each of the hollow spokes including a plurality of first fuel injection passages for injecting fuel into the annulus to mix with air, thereby forming a fuel and air mixture; and a plurality of downstream air passages extending through the base body in fluid communication with the truncated conical section of the chamber and the outside of the base body for introducing air flow into the chamber to further mix with the fuel and air mixture.

5. A mixer as claimed in claim 4 wherein the end body comprises a central passage extending axially from the upstream end thereof to the bottom end of the chamber for supplying air flow into the chamber.

6. A mixer as claimed in claim 5 wherein the central passage comprises a plurality of second fuel injection passages adjacent to the bottom of the chamber and extending through the central member for selectively injecting fuel into the central passage to mix with air.

7. A mixer as claimed in claim 6 wherein the base body comprises a plurality of fuel passages in fluid communication with the respective hollow spokes and a first external fuel passage.

8. A mixer as claimed in claim 7 wherein the second fuel injection passages are connected to a second external fuel passage.

9. A mixer as claimed in claim 6 wherein the first and second fuel injection passages are adapted to inject gaseous and liquid fuels, respectively.

10. A mixer as claimed in claim 4 wherein the upstream air passages extend axially and circumferentially with respect to the central axis to create air swirl in the annulus.

11. A mixer as claimed in claim 4 wherein the downstream air passages extend radially and circumferentially with respect to the central axis to create air swirl in the cavity.

12. A mixer as claimed in claim 4 further comprising a tube connected at one end thereof to the downstream open end of the base body and adapted to be connected at the other end thereof to the combustor for delivery of the fuel and air mixture.

13. A mixer as claimed in claim 12 further comprising a can connected to a pressurized air source, the can housing the end body and at least a portion of the base body, communicating with the upstream and downstream air passages to supply air flow.

14. A mixer as claimed in claim 4 wherein the base body and the end body are made in a machining process.

15. A mixer as claimed in claim 4 wherein the base body and end body are made in a casting process.

* * * * *